United States Patent [19]

Jensen

[11] Patent Number: 5,022,169

[45] Date of Patent: Jun. 11, 1991

[54] APPARATUS FOR IRONING LAUNDRY

[75] Inventor: Jorn M. Jensen, Bern, Switzerland

[73] Assignee: Jensen Holding AG, Burgdorf, Switzerland

[21] Appl. No.: 483,022

[22] Filed: Feb. 22, 1990

[30] Foreign Application Priority Data

Feb. 23, 1989 [NL] Netherlands ..... 8900457

[51] Int. Cl.[5] ..... D06F 65/10; D06F 65/00

[52] U.S. Cl. ..... 38/56; 38/44; 38/54

[58] Field of Search ..... 38/44, 45, 46, 62

[56] References Cited

U.S. PATENT DOCUMENTS

| | | | |
|---|---|---|---|
| 1,990,648 | 2/1935 | Herzog | 38/56 |
| 2,225,166 | 12/1940 | Erby | 38/44 X |
| 2,362,947 | 11/1944 | Sullivan | 38/52 |
| 4,414,765 | 11/1983 | Kreinberg | 38/54 |
| 4,418,486 | 12/1983 | Kober | 38/44 X |
| 4,457,087 | 7/1984 | Wolff | 38/55 X |
| 4,485,571 | 12/1984 | Berger | 38/44 X |
| 4,599,814 | 7/1986 | Geiger | 38/55 X |
| 4,688,335 | 8/1987 | Krill | 38/44 X |
| 4,787,157 | 11/1988 | Ferrage | 38/47 X |

FOREIGN PATENT DOCUMENTS

| | | | |
|---|---|---|---|
| 0053088 | 6/1982 | European Pat. Off. . | |
| 0105519 | 4/1984 | European Pat. Off. . | |
| 3310019 | 9/1984 | Fed. Rep. of Germany | 38/44 |
| 3519623 | 12/1986 | Fed. Rep. of Germany . | |
| 1137332 | 5/1957 | France . | |
| 8401435 | 12/1985 | Netherlands . | |
| 1113110 | 5/1968 | United Kingdom | 38/44 |
| 2102843 | 2/1983 | United Kingdom | 38/57 |

*Primary Examiner*—Werner H. Schroeder
*Assistant Examiner*—Ismael Izaguirre
*Attorney, Agent, or Firm*—Fidelman & Wolffe

[57] ABSTRACT

An apparatus for ironing laundry comprising at least one semi-circular open dished bed (1), provided with a double wall with feed (5) and outlet (6) opening for passage of a heating medium, such as steam, and a roll (2) rotatably driven in each dished bed (1), wherein the outlet opening (6) of a dished bed (1) is placed in direct connection to the feed opening (5) of the following dished bed (1). The apparatus requires a high flowspeed of heating medium thereby preventing eventual condensation of the heat medium in the flow ducts in the dished bed wall, and also preventing an uneven temperature distribution in the inner wall of the dished bed.

14 Claims, 3 Drawing Sheets

APPARATUS FOR IRONING LAUNDRY

BACKGROUND OF THE INVENTION

The invention relates to an apparatus for ironing laundry, said apparatus comprising at least one semi-circular open dished bed provided with a double wall with feed and outlet opening for passage of a heating medium, such as steam, and a roll rotatably driven in each dished bed.

Such apparatus is known in different embodiments, but particularly with the dished bed construction. The type of heating medium is chosen depending on the construction used and, if steam is chosen, the danger of condensation in the dished bed must be prevented. Condensation that may occur has the drawback that the temperature distribution in the inner wall of the dished bed becomes uneven, which has a detrimental effect on the ironing process. This assumes a particularly significant character if more than one dished bed is employed in the apparatus.

SUMMARY OF THE INVENTION

The invention has for its object to provide an apparatus in which the above drawback is obviated and provides to this end an apparatus which is distinguished in that the outlet opening of a dished bed is placed in direct connection to the feed opening of the following dished bed.

The heating medium will therefore successively heat the dished beds connected in series, which requires a high flow speed for a good operation. This high flow speed prevents eventual condensation forming in the flow ducts in the dished bed wall.

Each dished bed wall is preferably embodied with flow ducts connected in series and extending in an axial direction. The flow speed is hereby increased still further and not only is condensation forming prevented as much as is possible but, in the case it should nevertheless occur, this condensation is immediately carried along with the steam to a water separator arranged in the system.

In accordance with a further development it is recommended that the water separator be placed directly by the outlet opening of a dished bed, whereby condensation is prevented from being carried along to the following dished bed.

In an apparatus wherein more than one dished bed are placed one after the other a bridge piece is normally arranged to guide the laundry out of the one dished bed and into the other, this bridge piece usually being heated. In this embodiment it is recommended according to the invention to feed the bridge with a steam line formed by the outlet line of the final dished bed.

In the case that a steam trap connected to a joint outlet line is arranged after each water separator and/or bridge piece, it is recommended according to the invention that a venting valve be arranged parallel to the final steam trap. Use of such a venting valve ensures that the whole system can be blown through, whereby collection of air or other noncondensing gases in the steam areas can be avoided with hundred percent certainty.

Vapor lock in the system can be prevented by arranging on the steam trap a venting line which leads to the steam line of the following element or to the venting valve.

The invention will be further elucidated in the figure description hereinafter of an embodiment.

DESCRIPTION OF THE PREFERRED EMBODIMENTS

Figure 1:
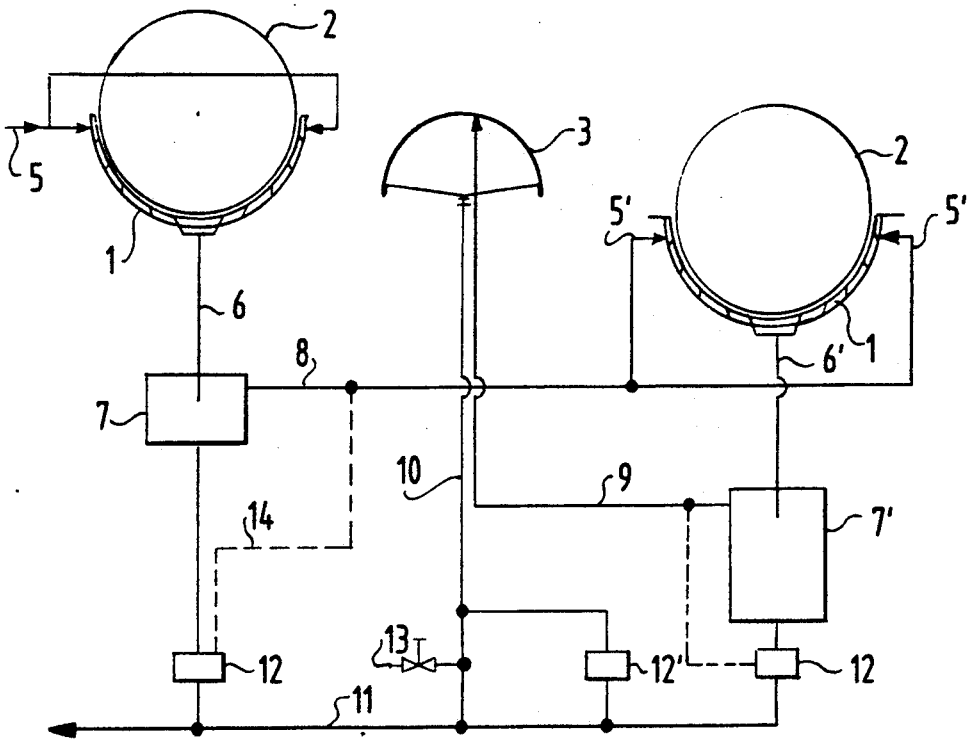
FIG. 1 shows a schematic view of an apparatus provided with two dished beds having rolls driven rotatably therein and provided with a bridge piece, and a flow diagram.
Figure 4:
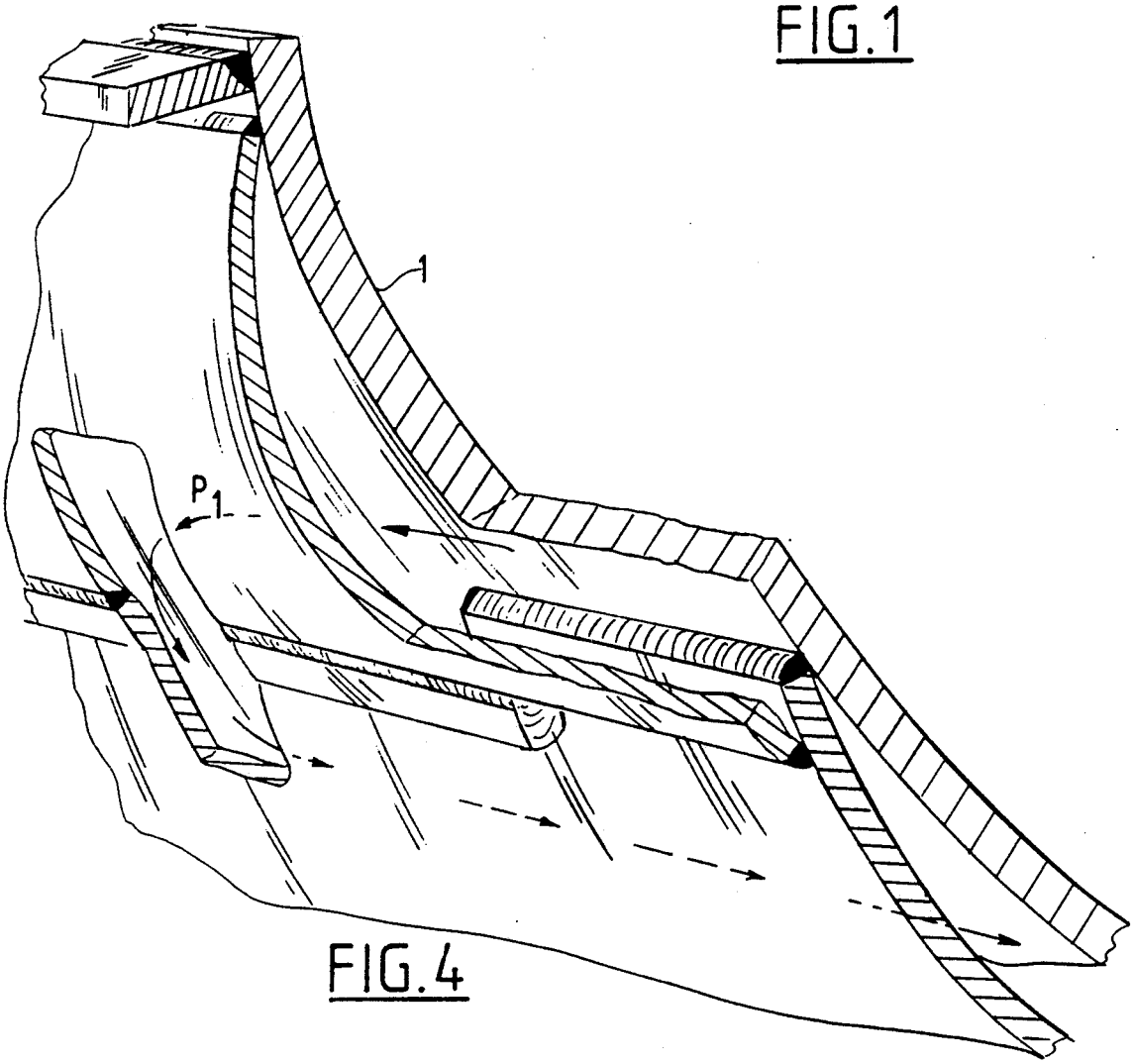
FIG. 4 is a perspective view of a detail as according to section IV of the dished bed wall in FIG. 2.
Figure 2:
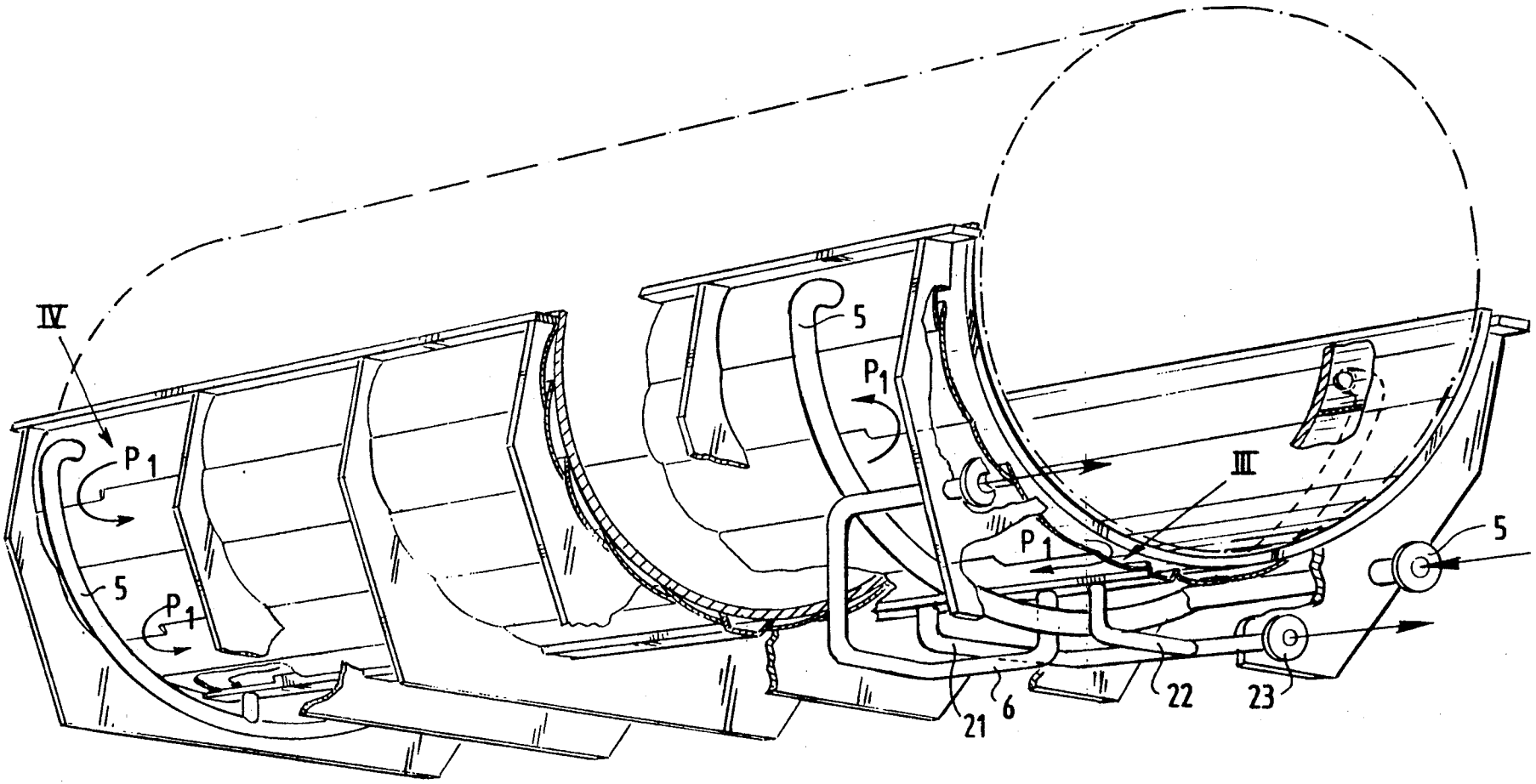
FIG. 2 is a perspective view of a dished bed used with the apparatus as in FIG. 1.

FIG. 1 shows two dished beds 1 having arranged therein rotatably driven rolls 2, the driving and construction whereof fall outside the scope of the invention. It is generally known that the dished bed 1 is double-walled, wherein the wall is heated by a medium to be further elucidated below, here superheated steam at a determined pressure and temperature. Placed between the dished beds 1 is a bridge 3, wherein it must be assumed that the inner wall of the dished bed 1 makes a smooth connection onto the outer wall of bridge 3 which in turn then connects smoothly onto the inner wall of the following dished bed. This serves to guide the laundry that is fed in the usual manner between the roll 2 and the inner wall of the dished bed 1, heated and therefore ironed and subsequently guided again via the bridge 3 into the following dished bed 1 to be subjected once again to an ironing operation.

The invention relates to the heating system for heating the inner wall of the dished bed 1.

From a heating source (not shown), for example a steam boiler, steam or a similar hot gas is carried via the feed line 5 to the two opposite upper edges of the dished bed 1. The wall of the dished bed 1 is embodied with lengthwise ducts which extend in axial direction and which are moreover connected to each other in series, which gives rise to a zigzag-like flow path, this being indicated with the arrows $P_1$. The wall takes an exactly symmetrical form so that the outlet opening is located on the underside of the dished bed, which outlet is designated with the reference numeral 6. The steam line 6 leads to a water separator 7, of which the steam line 8 is fed through directly to the feed openings for the steam of the following dished bed 1, which are designated here with the numeral 5'. The outlet 6' of the dished bed leads to a second water separator 7' of which the outlet steam line 9 leads to the bridge piece 3. The bridge piece 3 is provided with an outlet line 10 which leads directly to a common outlet line 11 for the condensate.

A steam trap 12 is arranged between the water separators 7' and the common outlet line 11 as well as between the outlet line 10 and the common outlet line 11 of the bridge piece 3.

Arranged in parallel to the final steam trap is a venting valve 13.

In order to be able to vent the steam traps 12 a venting line is connected thereto which either leads to the outlet line 8 or 9 from the first water separator or the second water separator respectively or leads directly to the outlet line 10 coming from the bridge piece 3.

It will be apparent from the above discussed diagram that as a result of the series connection of the dished beds 1, a high steam speed can be maintained in the lines 6, 8, 9 and 10, which prevents condensation occurring in the axially directed lengthwise ducts in the dished beds 1. If this should nevertheless be the case the high flow speed will ensure that it is carried along to the water separators 7 located after the dished beds 1.

Venting can be carried out in simple manner via the venting valve 13 arranged as the final one in the system which ensures that all the air and other non-condensing gases will be removed from the system. The short-circuit line 14 provides venting of the steam traps 12.

Figure 3:
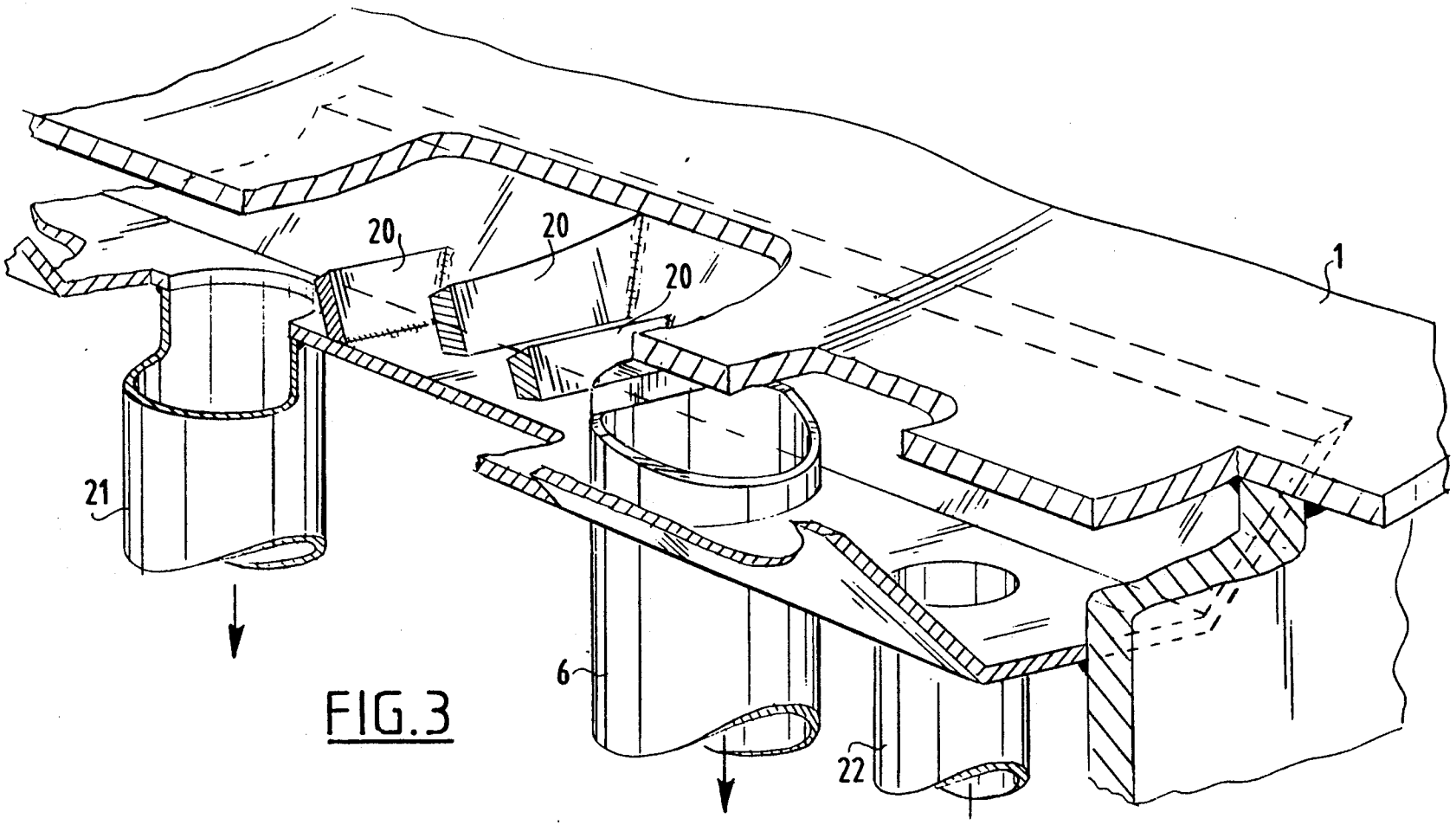
FIG. 3 is a perspective view, partly in section, of a detail of the water separator used with a dished bed as in section III of FIG. 2.

FIG. 3 shows a detail of the underside of the dished bed 1 wherein the outlet opening of the outlet pipe 6 for the steam out of the lowest most central lengthwise duct in the double wall of the dished bed 1 is shown in detail. Before the steam outlet 6 are placed baffle plates 20 which form a labyrinth for collecting condensation that has been carried along out of the lengthwise ducts of the dished bed 1. The captured condensation is discharged into the condensation outlet 21 and 22. These lead to a common condensation outlet 23 which can be connected directly onto the condensation outlet 11 in FIG. 1.

The invention is not limited to the above described embodiment.

I claim:

1. An apparatus for ironing laundry comprising:

a series of semi-circular dished beds each comprising an inner wall, an outer wall and an interspace therebetween, each of said dished beds comprising receiving means for receiving a heating medium in the interspace thereof, and outlet means for discharging said heating medium from the interspace thereof, such that said heating medium passes through said interspace from the feed means to the outlet means; and corresponding rotatably driven rollers, wherein a surface of each of said rollers is opposed to the inner wall of each of said dished beds in said series;

wherein the outlet means of a first dished bed in said series is directly connected to the feed means of a following dished bed in said series.

2. The apparatus of claim 1, further comprising a bridge piece connecting said first and following dished beds in said series and means for feeding the heating medium to said bridge piece, wherein said means for feeding is connected to the output means of a final dished bed in said series.

3. The apparatus of claim 1, wherein each of said dished beds further comprises means for defining passage of the heating medium through the interspace thereof comprising axial flow ducts formed between the inner and outer walls and connected in series.

4. The apparatus of claim 3, further comprising a bridge piece connecting said first and following dished beds in said series and means for feeding the heating medium to said bridge piece, wherein said means for feeding is connected to the output means of a final dished bed in said series.

5. The apparatus of claim 3, wherein said heating medium is steam.

6. The apparatus of claim 5, further comprising water separation means for separating condensed water from steam, located in the vicinity of the outlet means of at least one of said dished beds in said series.

7. The apparatus of claim 6, wherein said water separation means comprises baffles within one of said axial flow ducts and condensation outlet means for discharging condensed water.

8. The apparatus of claim 7, wherein said water separation means is provided for each of said dished beds in said series.

9. The apparatus of claim 8, further comprising a bridge piece connecting said first and following dished beds in said series and means for feeding the heating medium to said bridge piece, wherein said means for feeding is connected to the output means of a final dished bed in said series, and water separation means for separating condensed water from steam at an output of said bridge piece.

10. The apparatus of claim 9, further comprising a steam trap in connection with each of said water separation means.

11. The apparatus of claim 10, wherein each steam trap is connected to a common outlet and a venting valve is provided in parallel to the steam trap connected to the water separation means of the bridge piece.

12. The apparatus of claim 8, further comprising a steam trap in connection with each of said water separation means.

13. The apparatus of claim 12, wherein each steam trap is connected to a common outlet.

14. The apparatus of claim 12, further comprising means for venting at least one of said steam traps.

* * * * *